US008671655B2

(12) United States Patent
Abercrombie, III et al.

(10) Patent No.: US 8,671,655 B2
(45) **Date of Patent: *Mar. 18, 2014**

(54) APPARATUS FOR PRESSURIZING CONTAINERS

(75) Inventors: James Scott Abercrombie, III, Greenwich, CT (US); Michael Edward Wood, Sinking Springs, PA (US); Nicholas Joseph Day, Henderson, NV (US)

(73) Assignee: Inoflate, LLC, Greenwich, CT (US)

( * ) Notice: Subject to any disclaimer, the term of this patent is extended or adjusted under 35 U.S.C. 154(b) by 257 days.

This patent is subject to a terminal disclaimer.

(21) Appl. No.: 12/319,074

(22) Filed: Dec. 31, 2008

(65) Prior Publication Data

US 2009/0120038 A1 May 14, 2009

Related U.S. Application Data

(60) Continuation of application No. 11/543,485, filed on Oct. 5, 2006, now Pat. No. 7,637,082, which is a division of application No. 10/986,568, filed on Nov. 10, 2004, now Pat. No. 7,159,374.

(60) Provisional application No. 60/518,806, filed on Nov. 10, 2003.

(51) Int. Cl.
*B65B 31/00* (2006.01)
*B65D 81/20* (2006.01)

(52) U.S. Cl.
USPC ..... 53/512; 53/127; 53/111 RC; 53/129.1; 206/213.1

(58) Field of Classification Search
CPC ..... B65D 81/2061; B65D 81/2053; B65D 81/2046; B65D 31/006
USPC ..... 206/320, 316.1, 521, 523, 585, 586, 206/588, 590, 591, 592, 594, 213.1; 53/432, 440, 485, 401, 420, 111 R, 53/111 RC, 512, 127, 129.1
See application file for complete search history.

(56) References Cited

U.S. PATENT DOCUMENTS 812,156 A * 2/1906 Sparre ..... 102/530
2,073,273 A 3/1937 Wetstein (Continued)

FOREIGN PATENT DOCUMENTS

DE 4036421 5/1992
EP 0258057 3/1988

(Continued)

OTHER PUBLICATIONS

Supplemental European Search Report May 15, 2009 for corresponding European Patent Application No. 04 81 0762, 3 pages.

*Primary Examiner* — Stephen F Gerrity
(74) *Attorney, Agent, or Firm* — Ohlandt, Greeley, Ruggiero & Perle, LLP

(57) ABSTRACT

Devices and a method for releasing gas in a container after closing and sealing to pressurize and/or prevent or counteract buckling thereof, and or provide structural rigidity and strength thereto and or release components. The method introduces a reactive agent into the container after filling and before sealing. The reactive agent is controlled to react to provide a gas and optionally components, which a) provides a positive pressure to prevent or counteract buckling and provide structural rigidity to the container, and b) and or changes the state or characteristics of the headspace and or contents of the closed container. The devices include a closure, a cap and a container. The reactive agent is brought to chemical reaction by moistening, heating, catalyst and the like. The closure includes the reactive agent and is disposed in the container. The external trigger is a device that emits energy that provides heat to the reactive agent to stimulate the chemical reaction.

11 Claims, 10 Drawing Sheets

(56) References Cited

U.S. PATENT DOCUMENTS

| | | | | | |
|---|---|---|---|---|---|
| 3,053,422 | A | | 9/1962 | Tenison et al. | |
| 3,607,303 | A | | 9/1971 | Bingham | |
| 3,718,236 | A | | 2/1973 | Reyner et al. | |
| 3,881,621 | A | | 5/1975 | Adomaitis | |
| 3,888,998 | A | | 6/1975 | Sampson et al. | |
| 3,911,071 | A | | 10/1975 | Naumann | |
| 3,992,493 | A | | 11/1976 | Whyte et al. | |
| 4,007,134 | A | | 2/1977 | Liepa et al. | |
| 4,025,655 | A | | 5/1977 | Whyte et al. | |
| 4,035,455 | A | | 7/1977 | Rosenkranz et al. | |
| 4,110,255 | A | | 8/1978 | Liepa et al. | |
| 4,134,510 | A | | 1/1979 | Chang | |
| 4,177,239 | A | | 12/1979 | Gittner et al. | |
| 4,186,215 | A | | 1/1980 | Buchel | |
| 4,214,011 | A | | 7/1980 | Strube | |
| 4,231,483 | A | | 11/1980 | Dechenne et al. | |
| 4,233,325 | A | * | 11/1980 | Slangan et al. | 206/219 |
| 4,316,409 | A | | 2/1982 | Adams et al. | |
| 4,342,398 | A | | 8/1982 | Chang | |
| 4,381,061 | A | | 4/1983 | Cerny et al. | |
| 4,458,584 | A | | 7/1984 | Annese et al. | |
| 4,465,199 | A | | 8/1984 | Aoki | |
| 4,466,342 | A | | 8/1984 | Basile et al. | |
| 4,496,517 | A | | 1/1985 | Kinoshita et al. | |
| 4,596,713 | A | * | 6/1986 | Burdette | 426/107 |
| 4,613,330 | A | | 9/1986 | Michelson | |
| 4,642,968 | A | | 2/1987 | McHenry et al. | |
| 4,662,154 | A | | 5/1987 | Hayward | |
| 4,667,454 | A | | 5/1987 | McHenry et al. | |
| 4,826,695 | A | | 5/1989 | Tanner | |
| 4,969,563 | A | | 11/1990 | Strassheimer | |
| 4,979,673 | A | | 12/1990 | Wilk | |
| 5,033,254 | A | | 7/1991 | Zenger | |
| 5,054,651 | A | | 10/1991 | Morane | |
| 5,234,126 | A | | 8/1993 | Jonas et al. | |
| 5,251,424 | A | | 10/1993 | Zenger et al. | |
| 5,269,437 | A | | 12/1993 | Gygax | |
| 5,270,069 | A | | 12/1993 | Plester | |
| 5,370,042 | A | * | 12/1994 | Tolchin et al. | 99/417 |
| 5,383,324 | A | | 1/1995 | Segers et al. | |
| 5,389,332 | A | | 2/1995 | Amari et al. | |
| 5,538,567 | A | * | 7/1996 | Henry et al. | 149/18 |
| 5,549,037 | A | * | 8/1996 | Stumphauzer et al. | 99/323.1 |
| 5,588,556 | A | | 12/1996 | Sancoff et al. | |
| 5,624,645 | A | | 4/1997 | Malley | |
| 5,705,211 | A | | 1/1998 | Bedell et al. | |
| 5,763,030 | A | | 6/1998 | Matsui | |
| 5,884,792 | A | | 3/1999 | Krishnakumar et al. | |
| 5,980,959 | A | * | 11/1999 | Frutin | 53/420 |
| 6,176,382 | B1 | | 1/2001 | Bazlur Rashid | |
| 6,244,022 | B1 | | 6/2001 | Cornell et al. | |
| 6,299,007 | B1 | | 10/2001 | Takeuchi | |
| 6,390,292 | B2 | | 5/2002 | Hawthorne | |
| 6,394,264 | B2 | * | 5/2002 | Riviello, Jr. | 206/213.1 |
| 6,412,526 | B2 | | 7/2002 | Castillo | |
| 6,541,055 | B1 | | 4/2003 | Luzenberg | |
| 6,926,138 | B1 | | 8/2005 | Basham et al. | |
| 7,922,984 | B2 | * | 4/2011 | Hamilton et al. | 206/213.1 |
| 2002/0179461 | A1 | | 12/2002 | Mollstam et al. | |
| 2003/0017236 | A1 | | 1/2003 | Makita et al. | |
| 2003/0116522 | A1 | | 6/2003 | Julian et al. | |
| 2004/0026270 | A1 | | 2/2004 | Liang | |
| 2009/0255929 | A1 | * | 10/2009 | Abercrombie et al. | 220/212 |

FOREIGN PATENT DOCUMENTS

| | | |
|---|---|---|
| EP | 0 314 554 | 5/1989 |
| FR | 2 630 090 | 10/1989 |
| GB | 2076628 | 12/1981 |
| WO | WO/99/44901 | 9/1999 |

* cited by examiner

APPARATUS FOR PRESSURIZING CONTAINERS

RELATED APPLICATION

This application claims the benefit of and is a continuation of U.S. patent application Ser. No. 11/543,485, filed on Oct. 5, 2006, now U.S. Pat. No. 7,637,082, which claims the benefit of and is a Divisional Application of U.S. patent application Ser. No. 10/986,568, filed on Nov. 10, 2004, now U.S. Pat. No. 7,159,374, which claims the benefit of U.S. Provisional Patent Application No. 60/518,806, filed on Nov. 10, 2003, the entire contents of each is hereby incorporated by reference.

FIELD OF THE INVENTION

This invention relates to a method and to a device that release a gas and or other compounds in a closed hot or cold filled container to (a) prevent or counteract buckling thereof, (b) provide structural rigidity and strength thereto, and (c) so that components may be added after closing and sealing the container. The devices of the invention include a container and a cap. The container may be partially filled with liquid or solid products.

BACKGROUND OF THE INVENTION

To prevent microbial spoilage, a hot fill process is often used to package many food and beverage products at high temperatures to sterilize both the product and container. When the liquid content of the container cools, it contracts and either creates an internal vacuum or causes the container to deform, as by shrinking, buckling or paneling. Currently, plastic bottles are designed with panels, ribs and additional resin to compensate for the contraction and prevent bottle deformation. When the smooth side wall of the bottle is replaced with these panels, flexible packaging shapes and designs are prevented, thereby making label application difficult.

An approach to the bottle deformation problem adds a gas, such as carbon dioxide or liquid nitrogen to the bottle after the liquid is hot-filled and before sealing. This approach is described in U.S. Pat. Nos. 4,662,154, 5,033,254 and 5,251, 424 and in German Offenlegungsschrift No. DE 40 36 421 A 1. For example, the process described in U.S. Pat. No. 5,251, 424 introduces liquid nitrogen into the bottle before sealing to prevent thermal distortion of the bottle upon cooling of the hot liquid.

After closing, the gas expands within the headspace and the pressure inside the container rises rapidly providing rigidity to the container. This operation is most effective when applied to cold filled plastic containers that can accept relatively high pressures without stretching and deforming. At hot fill temperatures, however, the container looses its design strength. This loss of strength allows the container to stretch and deform, making it impossible to pressurize the container to the same pressure levels that can be achieved with cold fill operations.

Another approach to the bottle deformation problem adds a carbon dioxide releasing device to the container before sealing. This approach is described in U.S. Pat. Nos. 5,270, 069 and 6,244,022. For example, the device described in U.S. Pat. No. 5,270,069 comprises a pencil shaped device that includes two compartments in which are disposed different reagents that, when brought into contact, react to release carbon dioxide into the headspace of the bottle. The user must remove the device before consuming the beverage.

Packaged beverages that contain a carbonation device that is activated at the point of consumption to carbonate the beverage are described in U.S. Pat. Nos. 3,888,998, 4,007, 134, 4,110,255, 4,186,215, 4,316,409, 4,458,584, 4,475,448, 4,466,342 and in British Patent Application GB 2 076 628 A. Sieve tablets used in many of these devices are described in U.S. Pat. Nos. 3,888,998, 4,007,134, and 4,110,255, as well as in U.S. Pat. Nos. 4,025,655 and 4,214,011. These sieve tablets leave a residue that must be removed from the beverage prior to consumption.

In a hot fill process, the food and beverage products are pasteurized and then filled into containers at high temperature. The entire heating and cooling cycle can take a significant amount of time meaning that the actual food or beverage components are exposed to high temperatures for extended periods of time. During this time, certain components referred to as "Heat Sensitive Components" can become degraded by the high temperatures and lose their true aromatic and flavor characteristics.

Thus, there is a need for a method that releases gas in a closed container to retain microbial stability without leaving a residue or a device that must be removed at time of consumption.

There is also a need to eliminate buckling or paneling in closed hot filled containers in order to capture decorative, lightweight and flexibility benefits.

There is also a need to sufficiently pressurize a closed hot filled container in order to capture structural benefits without deforming the container.

There is a further need to release ingredients and functional components to closed containers on a time delayed basis to enhance functionality.

There is still another need for a container in which gas can be released to pressurize the container after the container is sealed.

There is yet another need for a closure or cap for a container that can release gas into the container after sealing to pressurize the container.

SUMMARY OF THE INVENTION

A container of the present invention comprises a compartment that is partially filled with one or more products and an insert disposed in the compartment. The insert comprises a reaction chamber and at least one reactive agent that is triggerable to a chemical reaction in the reaction chamber to produce a gas that is released to the compartment so as to pressurize the compartment.

In another embodiment of the container of the present invention, the insert further comprises a heating element that, when activated by an external energy source, provides heat to trigger the chemical reaction.

In another embodiment of the container of the present invention, the external energy source provides thermal energy in a form selected from the group consisting of: radiant heat, heated air, electromagnetic energy in the radio frequency (RF), high frequency (HF), very high frequency (VHF) and ultra high frequency (UHF) ranges, microwave, gamma, X-ray, ultraviolet, infrared, electromagnetic heat induction, ultrasonic energy, thermo sonic energy, laser energy, electric current and any combination thereof.

In another embodiment of the container of the present invention, the reactive agent is selected from the group consisting of: carbonates, nitrites, nitrates, ammonium compounds, acetates, ozones, peroxides and combinations thereof.

In another embodiment of the container of the present invention, the insert further comprises a member of the group consisting of: components and layers, liners, seals, reactive agents, membranes, coatings, films, inductive plates, electrodes, dielectrics, absorbents, conductors, insulators, separators, jackets, shields, fuses, spacers, stators, coils, catalysts and inhibitors and any combination thereof.

In another embodiment of the container of the present invention, the chemical reaction is triggered by one selected from the group consisting of: catalyst, moisture, heat and any combination thereof.

In another embodiment of the container of the present invention, the insert further comprises a separator that separates the reactive agent from another agent, and wherein the separator is at least partially dissolved by moisture to allow the reactive agent and the agent to come into contact with one another in the reaction chamber.

In another embodiment of the container of the present invention, the insert includes a plurality of layers, wherein the reaction chamber is disposed between at least first and second ones of the layers.

In another embodiment of the container of the present invention, the first layer includes one or more weakened areas that rupture as the gas pressurizes the reaction chamber to allow the gas to escape into the compartment.

In another embodiment of the container of the present invention, one of the plurality of layers includes a heating element that, when activated by an external energy source, provides heat to trigger the chemical reaction.

In another embodiment of the container of the present invention, the heating element is one of the first and second layers.

In another embodiment of the container of the present invention, the heating element is an inductor that conducts electricity when subjected to an electromagnetic field.

In another embodiment of the container of the present invention, one of the layers is a semi-permeable membrane that allows the gas to escape to the compartment.

In another embodiment of the container of the present invention, the compartment further comprises a neck with a cap disposed on the neck. The insert is disposed on a surface of the cap.

In another embodiment of the container of the present invention, the gas enters a headspace of the compartment.

In another embodiment of the container of the present invention, the insert further comprises a pull tab that is bonded to the surface and that when pulled removes the insert from the surface.

In another embodiment of the container of the present invention, the product is liquid, which is initially hot. The compartment buckles as the liquid cools and the gas counteracts the buckling.

In another embodiment of the container of the present invention, components are released with the gas into the compartment.

In another embodiment of the container of the present invention, the components are disposed in the reaction chamber with the reactive agent.

In another embodiment of the container of the present invention, the components are selected from the group consisting of: water, vitamins, minerals, flavor components, preservatives, oxygen scavengers, salts, electrolytes, sterilants, medicines, nutrients, organoleptics, colorants and any combination thereof.

In another embodiment of the container of the present invention, the insert includes a plurality of layers and the reaction chamber is disposed between at least first and second ones of the layers.

In another embodiment of the container of the present invention, the first layer includes one or more weakened areas that rupture as the gas pressurizes the reaction chamber to allow the gas to escape into the compartment.

In another embodiment of the container of the present invention, one of the layers includes a heating element that when activated by an external energy source provides heat to trigger the chemical reaction.

In another embodiment of the container of the present invention, the heating element is one of the first and second layers.

In another embodiment of the container of the present invention, the heating element is an inductor that conducts electricity when subjected to an electromagnetic field.

In another embodiment of the container of the present invention, one of the layers is a semi-permeable membrane that allows the gas to escape into the compartment.

In another embodiment of the container of the present invention, one of the layers is a closure seal with a pull tab that is disposed between the surface and the reaction chamber.

In another embodiment of the container of the present invention, a secondary seal is disposed between the surface and the closure seal.

In another embodiment of the container of the present invention, the layers further comprise a third layer that is a closure seal and a fourth layer that is an insulator disposed between the third layer and the second layer. The first and second layers are each an inductor.

A method of the present invention comprises filling a container at least partially with a product, closing the container and disposing an insert in the container. The insert comprises a reaction chamber and at least one reactive agent that is triggerable to a chemical reaction in the reaction chamber to produce a gas that is released to the compartment so as to pressurize the container.

In another embodiment of the method of the present invention, components are concurrently released with the gas into the container.

In another embodiment of the method of the present invention, the chemical reaction is triggered by one selected from the group consisting of: catalyst, moisture, heat and any combination thereof.

In another embodiment of the method of the present invention, the heating is provided by an induction heater.

In another embodiment of the method of the present invention, the heating is selected from the group consisting of: radiant heat, heated air, electromagnetic energy in the radio frequency (RF), high frequency (HF), very high frequency (VHF) and ultra high frequency (UHF) ranges, microwave, gamma, X-ray, ultraviolet, infrared, electromagnetic heat induction, ultrasonic energy, thermo sonic energy, laser energy, electric current and any combination thereof.

In another embodiment of the method of the present invention, the reactive agent is selected from the group consisting of: carbonates, nitrites, nitrates, ammonium compounds, acetates, ozones, peroxides and combinations thereof.

In another embodiment of the method of the present invention, the insert further comprises a separator that separates the reactive agent from another agent. The method further comprises at least partially dissolving the separator with moisture to allow the reactive agent and the agent to contact one another in the reaction chamber.

In another embodiment of the method of the present invention, the components are selected from the group consisting of: water, vitamins, minerals, flavor components, preservatives, oxygen scavengers, salts, electrolytes, sterilants, medicines, nutrients, organoleptics, colorants and any combination thereof.

In another embodiment of the method of the present invention, the insert includes a plurality of layers. At least first and second ones of the layers are sealed with a region therebetween. The reactive agent is disposed in the reaction chamber.

In another embodiment of the method of the present invention, one of the layers is a heating element that when triggered by an external energy source heats the reactive agent.

In another embodiment of the method of the present invention, the heating element is one of the first and second layers.

In another embodiment of the method of the present invention, the heating element is an inductor that conducts electricity when subjected to an electromagnetic field.

In another embodiment of the method of the present invention, one of the layers is a semi-permeable membrane that allows the gas to escape into the container.

In another embodiment of the method of the present invention, the container comprises a neck and a cap, which is disposed on the neck. The insert is disposed on a surface of the cap.

In another embodiment of the method of the present invention, the gas enters a headspace of the container.

In another embodiment of the method of the present invention, the insert further comprises a pull tab that is bonded to the surface and that when pulled removes the insert from the surface.

In another embodiment of the method of the present invention, the product is liquid, which is initially hot. The container buckles as the liquid cools. The gas counteracts the buckling.

In another embodiment of the method of the present invention, components are released with the gas into the container.

In another embodiment of the method of the present invention, the components are disposed in the reaction chamber with the reactive agent.

In another embodiment of the method of the present invention, the components are selected from the group consisting of: water, vitamins, minerals, flavor components, preservatives, oxygen scavengers, salts, electrolytes, sterilants, medicines, nutrients, organoleptics, colorants and any combination thereof.

In another embodiment of the method of the present invention, the insert includes a plurality of layers. The reaction chamber is disposed between at least first and second ones of the layers.

In another embodiment of the method of the present invention, the first layer includes one or more weakened areas that rupture as the gas pressurizes the reaction chamber to allow the gas to escape into the container.

In another embodiment of the method of the present invention, one of the layers includes a heating element that when activated by an external energy source provides heat to trigger the chemical reaction.

In another embodiment of the method of the present invention, one of the layers is a closure seal with a pull tab that is disposed between the surface and the reaction chamber.

In another embodiment of the method of the present invention, a secondary seal is disposed between the surface and the closure seal.

In another embodiment of the method of the present invention, the layers further comprise a third layer that is a closure seal and a fourth layer that is an insulator disposed between the third layer and the second layer. The first and second layers are each an inductor.

A cap embodiment of the present invention comprises a rim that is styled for fitting on a container neck, a surface connected to the rim and an insert disposed on the surface. The insert comprises a reaction chamber and at least one reactive agent that is triggerable to a chemical reaction in the reaction chamber to produce a gas.

In another cap embodiment of the present invention, the insert further comprises a pull tab that is bonded to the surface and that when pulled removes the insert from the surface.

In another cap embodiment of the present invention, the product is liquid, which is initially hot. The compartment buckles as the liquid cools and the gas counteracts the buckling.

In another cap embodiment of the present invention, components are released with the gas into the compartment.

In another cap embodiment of the present invention, the components are disposed in the reaction chamber with the reactive agent.

In another cap embodiment of the present invention, the components are selected from the group consisting of: water, vitamins, minerals, flavor components, preservatives, oxygen scavengers, salts, electrolytes, sterilants, medicines, nutrients, organoleptics, colorants and any combination thereof.

In another cap embodiment of the present invention, the insert includes a plurality of layers, wherein the reaction chamber is disposed between at least first and second ones of the layers.

In another cap embodiment of the present invention, the first layer includes one or more weakened areas that rupture as the gas pressurizes the reaction chamber to allow the gas to escape into the compartment.

In another cap embodiment of the present invention, one of the layers includes a heating element that when activated by an external energy source provides heat to trigger the chemical reaction.

In another cap embodiment of the present invention, the heating element is one of the first and second layers.

In another cap embodiment of the present invention, the heating element is an inductor that conducts electricity when subjected to an electromagnetic field.

In another cap embodiment of the present invention, one of the layers is a semi-permeable membrane that allows the gas to escape to the compartment.

In another cap embodiment of the present invention, one of the plurality of layers is a closure seal with a pull tab that is disposed between the surface and the reaction chamber.

In another cap embodiment of the present invention, a secondary seal is disposed between the surface and the closure seal.

In another cap embodiment of the present invention, the layers further comprise a third layer that is a closure seal and a fourth layer that is an insulator disposed between the third layer and the second layer. The first and second layers are each an inductor.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENTS

Figure 1:
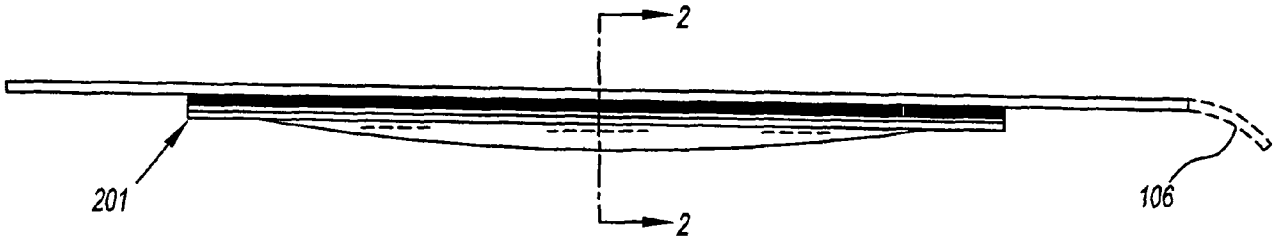
FIG. 1 is a view of an insert device of the present invention.
Figure 2:
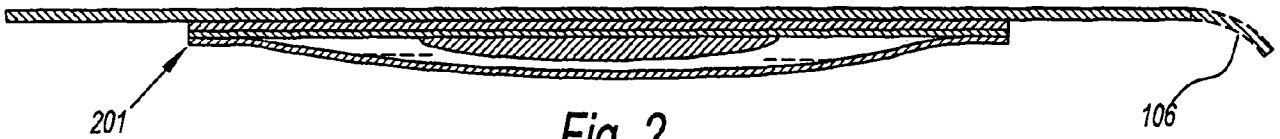
FIG. 2 is a cross-sectional view taken along the line 2 of FIG. 1.
Figure 3:
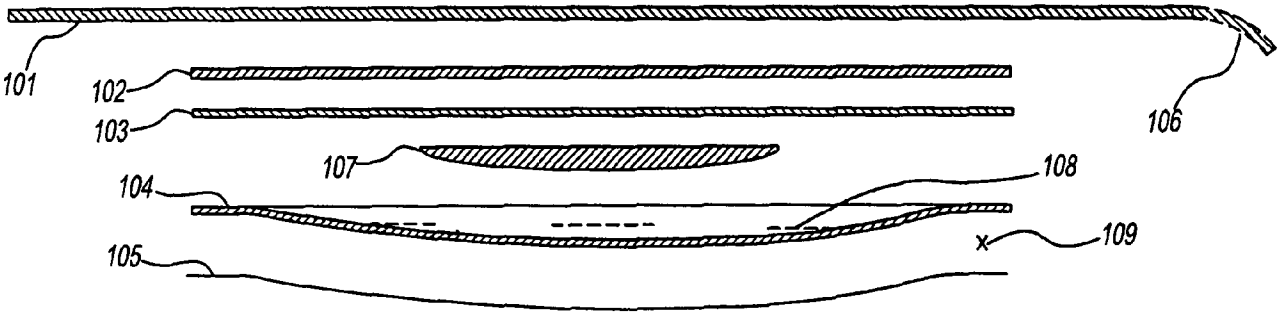
FIG. 3 is an exploded view of the cross-sectional view of FIG. 2.
Figure 4:
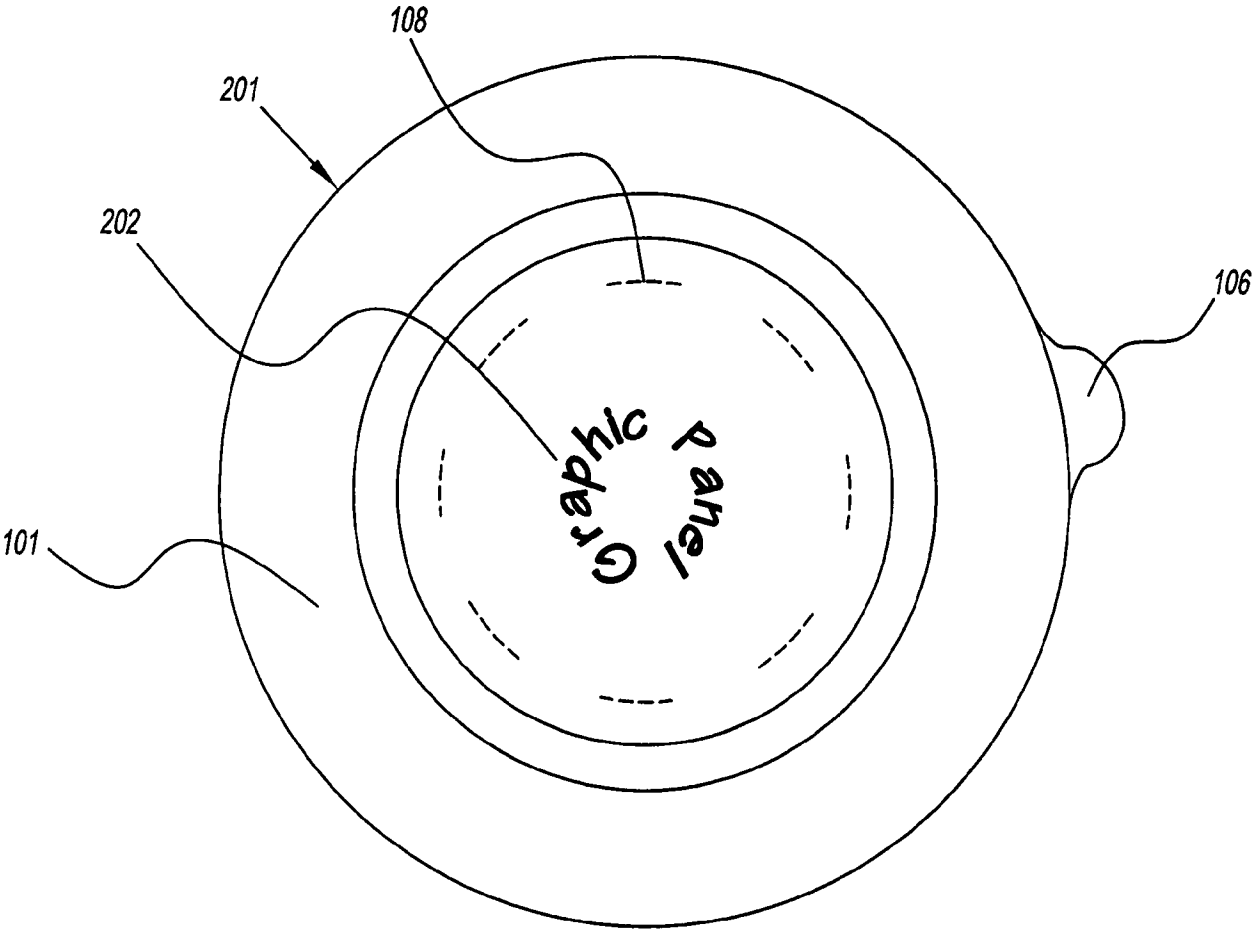
FIG. 4 is a bottom view of FIG. 1.
Figure 5:
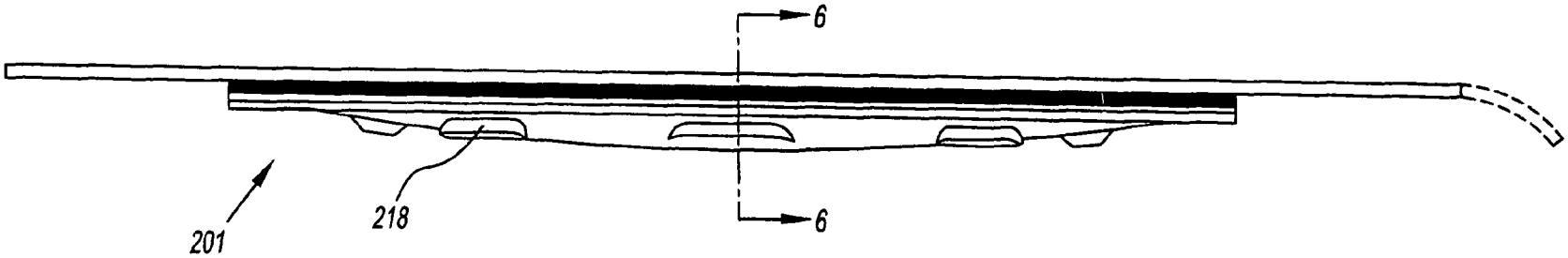
FIG. 5 is a view depicting action of the insert device during and after deployment.

While the invention is susceptible of embodiment in many different forms, the drawings show by way of example, preferred embodiments with the understanding that the present disclosure is to be considered as an exemplification of the principles of the invention and is not intended to limit the broad aspect of the invention to the embodiments illustrated.

Referring to FIGS. 1-4, an insert device 201 of the present invention includes a closure seal 101 that has a pull tab 106 to assist with removal at a future time. In an alternate preferred embodiment, closure seal 101 is simply a circular disc without a pull tab. In both preferred embodiments insert device 201 includes a graphic panel 202 that can contain graphics in the form of text or figures. Graphic panel 202, for example, may be disposed on a film seal 105.

Insert device 201 comprises a layered structure in the form of a disc, or other suitable shape, that includes closure seal 101 (with or without the pull tab 106), an insulator 102, a base inductor 103, a retaining shield inductor 104 that is weakened at points by one or more score marks 108, and a film seal 105 all joined together by a bonding agent 109. Sealed between base inductor 103 and retaining shield inductor 104 is a reactive agent 107.

In the following description, insert device 201 is considered active prior to the time reactive agent 107 is involved in a reaction and inactive or spent after the reaction.

Figure 6:
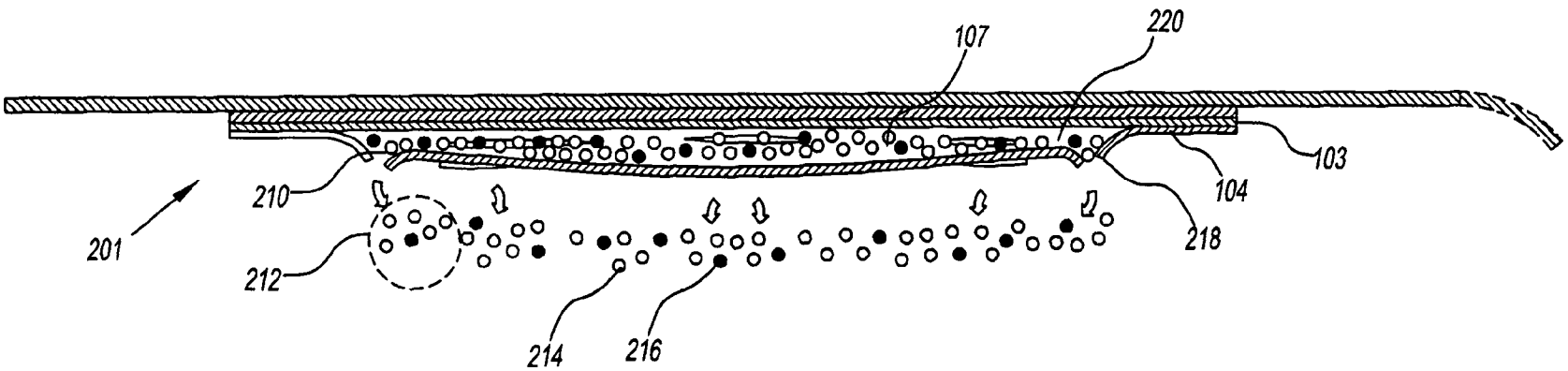
FIG. 6 is a cross-sectional view taken along line 6 of FIG. 5 depicting action of the insert device during deployment.

Referring to FIG. 6, during deployment of insert device 201, reactive agent 107 is caused to produce a chemical reaction 210 and liberate a mixture of a gas 214 and one or more components 216 in the form of a mixture 212. Reaction 210 takes placed in a reaction chamber 220 formed within the seal created by base inductor 103 and retaining shield inductor 104. Reaction 210 produces a positive pressure within reaction chamber 220 that shears retaining shield inductor 104 along score marks 108 (shown in FIGS. 1-4). The shearing action opens one or more rupture vents 218 at these points that allow mixture 212 to vent or escape through retaining shield inductor 104.

Figure 7:
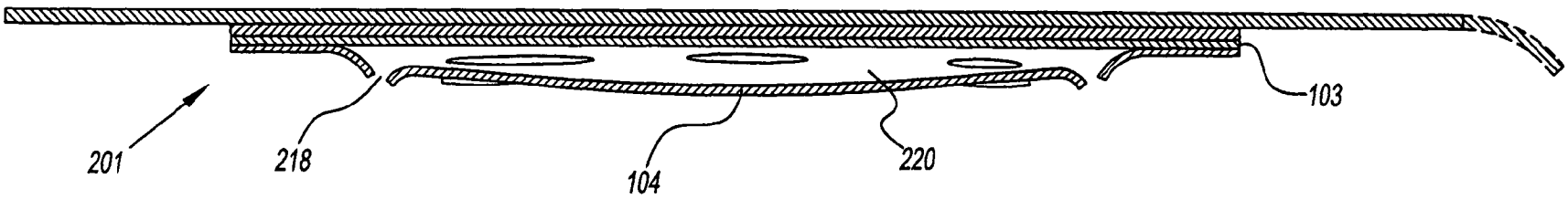
FIG. 7 is a cross-sectional view taken along line 6 of FIG. 5 depicting action of the insert device after deployment

Referring to FIG. 7, insert device 201 is depicted as spent after deployment. Insert device 201 when spent contains no more reactive agent 107. Rupture vents 218 are permanently opened in retaining shield inductor 104.

Reactive agent 107 may be any suitable reactive or non-reactive chemical compound that is simply dispensed from the insert device or react to produce a gas and or components. Reactive agent 107 may be selected from the groups or combinations of organic and non-organic chemicals and compounds available or yet to be developed. For example, reactive agent 107 may include carbonates, nitrites, nitrates, ammonium compounds, acetates, ozones, peroxides and combinations thereof.

Closure seal 101 may be any suitable liner or inner seal or combination of both and may be selected from the group consisting of: polyester coated foam, rubbers, corks, plastics, pulp board and paper. Insulator 102 may be any suitable insulator and may be selected from the group consisting of: paper board, polyesters, ceramics, corks, silicates, foams and plastics. Base inductor 103 may be any suitable metallic sheet, metalized film or foil and may be selected from the group consisting of: aluminum foil, precious and non precious metals. Retaining shield inductor 104 may be any suitable shield and may be selected from the group that includes aluminum foil, precious and non precious metals. Film seal 105 may be any suitable film and may be selected from the group that includes polyester film, latex, water soluble film and plastics. Pull tab 106 is integral with closure seal 101 and made from the same material. Bonding agent 109 may be any suitable fastening agent and may be selected from the group consisting of: adhesives, waxes, gums and epoxies.

Gas 214 is any suitable gas such as nitrogen N sub 2, nitrous oxide N sub 2 O, carbon dioxide C O sub 2 or a combination thereof.

Components 216 are formulated as heat sensitive ingredients or functional components that are best suited for time controlled release into the controlled environment of a closed container. Components 216 can include but are not limited to any and all of, water, vitamins, minerals, flavor components, preservatives, oxygen scavengers, salts, electrolytes, sterilants, medicines, nutrients, organoleptics, colorants and any combination thereof.

It will be apparent to those skilled in the art that materials other than the aforementioned materials can be used in the practice of the present invention.

Figure 8:
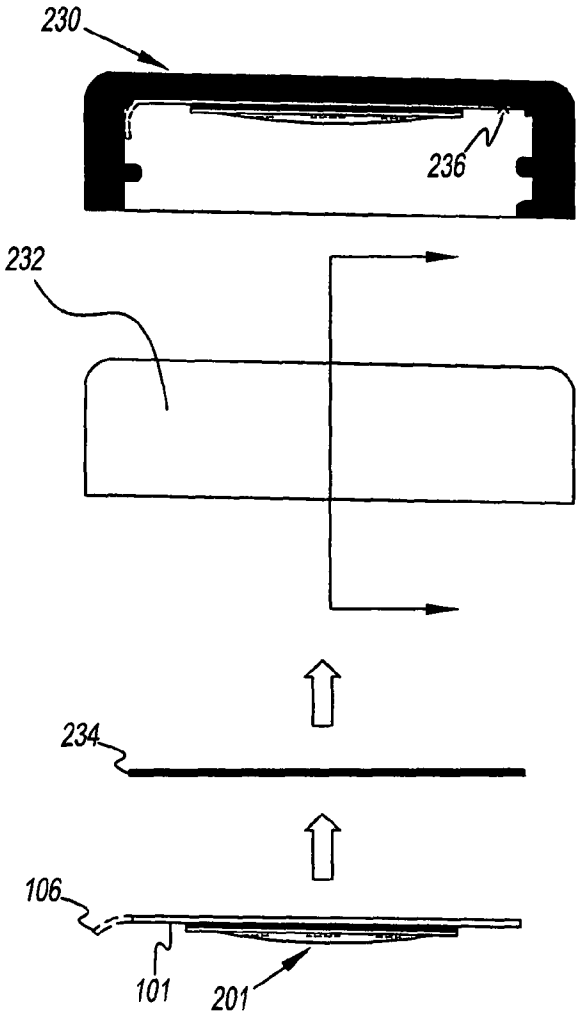
FIG. 8 is an exploded view of an active closure device of the present invention.

Referring to FIG. 8, an active closure 230 comprises a cap 232 into which insert device 201 with pull tab 106 has been inserted. Cap 232 is fitted with a secondary seal 234 inserted above insert device 201 in order to re-seal the container after removal of insert device 201 after being spent. Cap 232, secondary seal 234 and insert device 201 are joined together by a bonding agent 236. Bonding agent 236 may be any suitable bonding agent and may, for example, be an adhesive.

Figure 9:
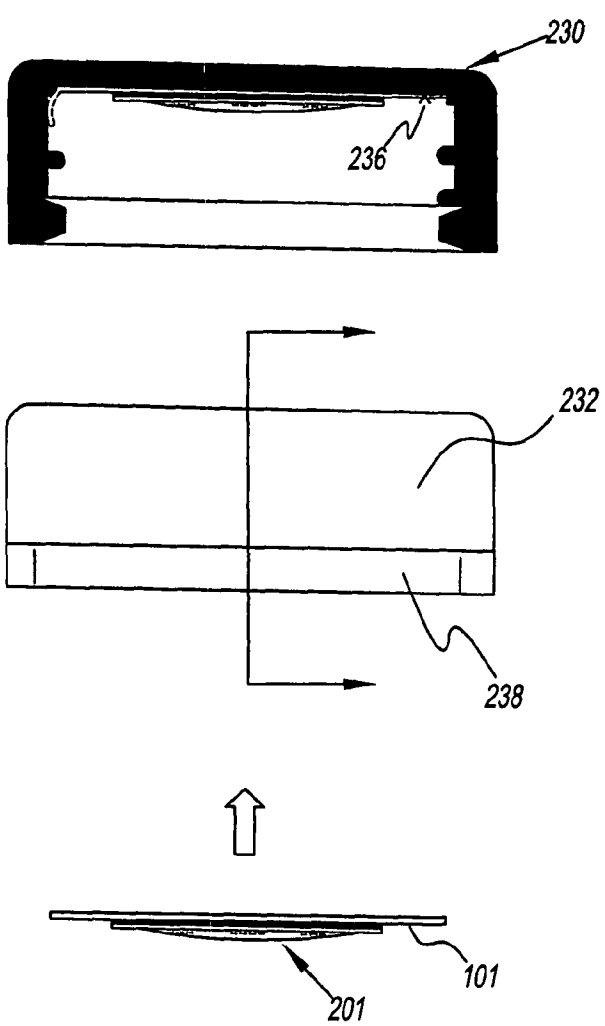
FIG. 9 is an exploded view of an alternate embodiment of the active closure device of the present invention.

Referring to FIG. 9, a preferred alternate embodiment of active closure 230 comprises cap 232 into which insert device 201 without pull tab has been inserted. Cap 232 has been modified to include a pilfer band 238 to assist with detecting pilferage once active closure 230 has been sealed onto a neck finish of a bottle.

Figure 11:
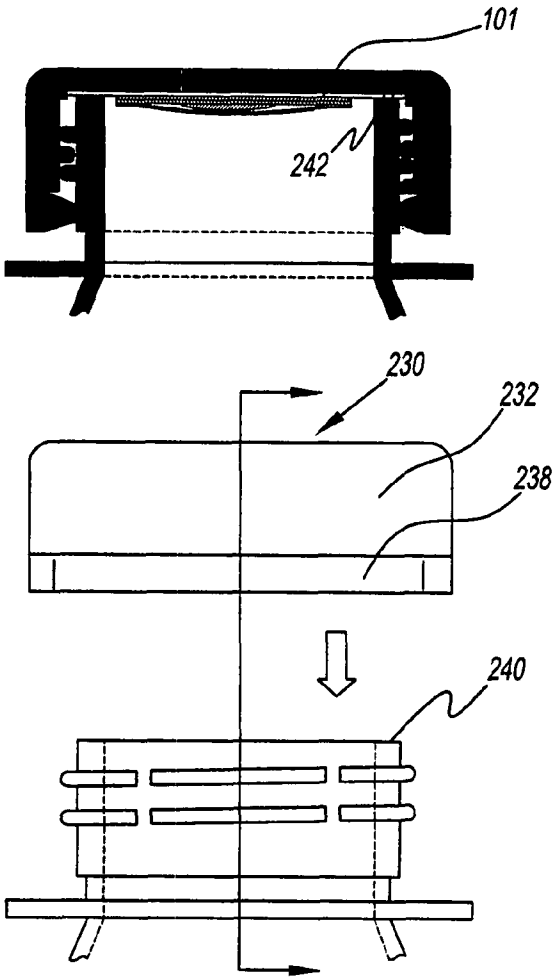
FIG. 11 is an exploded view as in FIG. 9, depicting the alternate embodiment of the active closure device disposed on a container neck.
Figure 10:
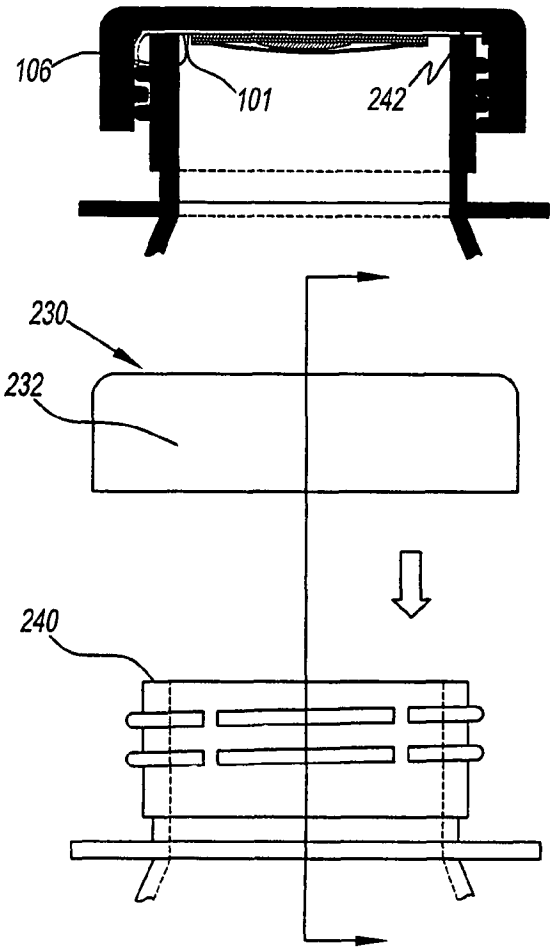
FIG. 10 is an exploded view as in FIG. 8, depicting the active closure device disposed on a container neck.

Referring to FIGS. 10 and 11, active closure 230 is disposed on a neck finish 240. In FIG. 10, active closure 230 is screwed onto neck finish 240 such that closure seal 101 with pull tab 106 is compressed between secondary seal 234 and neck finish 240, thereby creating a pressure bonded hermetic seal 242. In FIG. 11, active closure 230 without pull tab and with pilfer band 238 is screwed onto neck finish 240 such that closure seal 101 without pull tab 106 is compressed between cap 232 and neck finish 240, thereby creating a pressure bonded hermetic seal 242. Pressure bonded hermetic seal 242 comprises a liquid and gas tight seal where the pressure caused by application of the cap 232 bonds closure seal 101 to neck finish 240 by friction.

Figure 14:
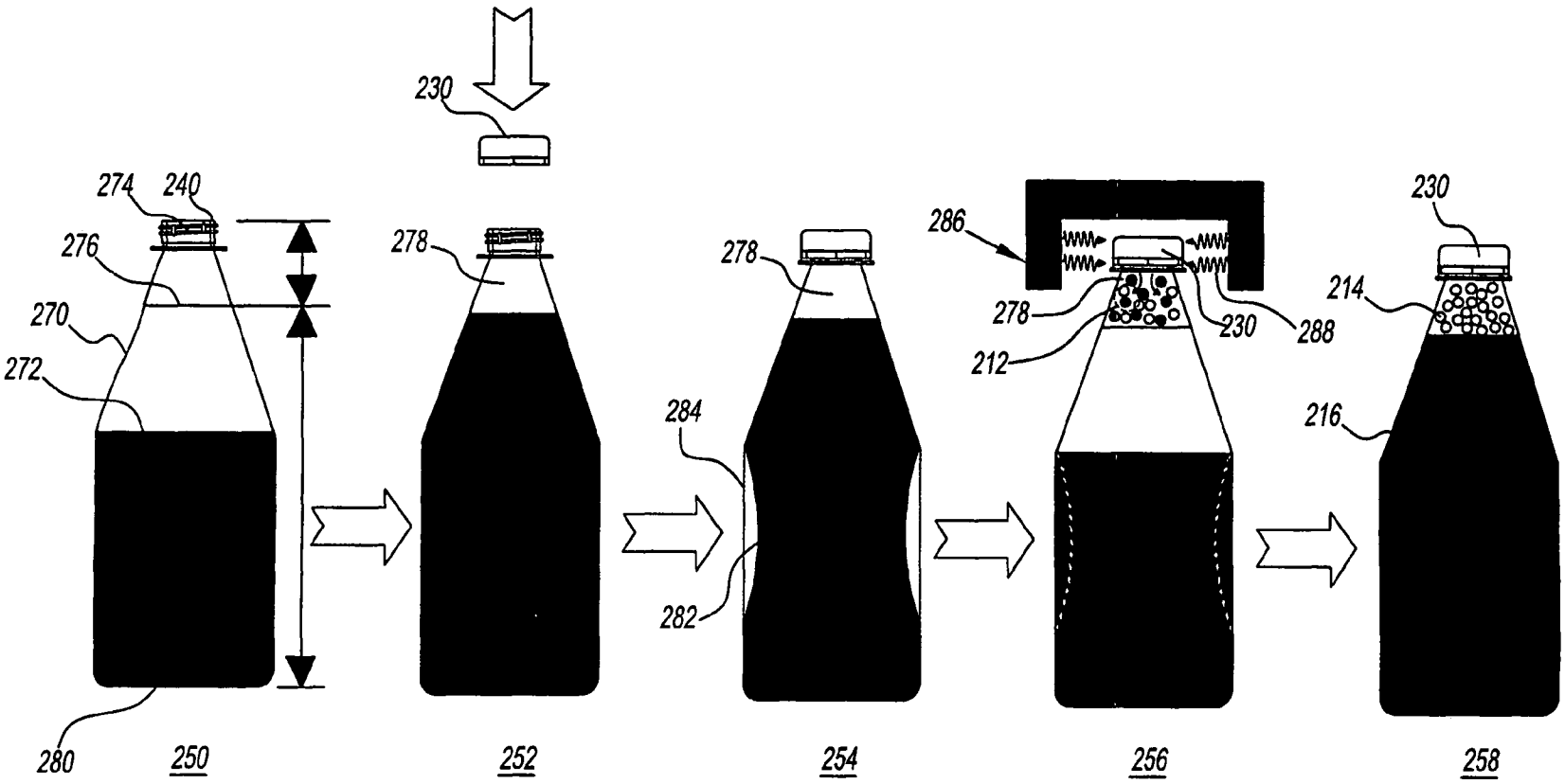
FIG. 14 depicts the method of the present invention.

Referring to FIG. 14, the method of the present invention begins with a hot filling step generally designated by reference numeral 250. A plastic container 270 is hot filled with a hot liquid 272 via an opening or neck 274, to a pre-determined fill level 276, leaving a headspace 278. Pre-determined fill level 276 can be any level between a base 280 and a top of neck finish 240 of container 270. After hot filling step 250 has been completed, the next step generally designated by reference numeral 252 closes and seals container 270 through the application of active closure 230.

After container 270 has been closed and sealed by active closure 230, the next step generally designated by reference numeral 254 cools container 270 and liquid 272. During cooling, container 270 dents, buckles or panels to form one or more recesses 282 due to a vacuum pressure being created through contraction in headspace 278 and liquid 272. However, container 270 will return to its design strength by the time liquid 272 cools to an adequate temperature, e.g., ambient, for the next step. The denting, buckling or paneling of container 270 can take place on one or more side walls 284, base 280 or any place on container 270 including any specially weakened area thereof designed to accommodate the effects of the vacuum pressure created in headspace 278 during cooling step 254.

Optionally, at the time of cooling step 254 or subsequent to closing and sealing step 252, container may be inverted to sterilize headspace 278.

In the next step generally designated by reference numeral 256, the reactive agent 107 contained in insert device 201 is triggered to react chemically. The triggering of reaction 210 occurs when active closure 230 is positioned under the influence of a triggering device 286. Triggering device 286 comprises an induction coil 288 that is disposed in relation to cap 232 so that when an electrical current flows in coil 288, an electromagnetic field encompasses base inductor 103 and retaining shield inductor 104. The electromagnetic field by induction causes a current to flow in inductors 103 and 104, that in turn raises the temperature of these inductors.

This increase in temperature in turn raises the temperature of the reactive agent 107. When the temperature of reactive agent 107 reaches a pre-determined level, reaction 210 is initiated in reaction chamber 220 in which reactive agent 107 reacts to produce a mixture 212 of gas 214 and components 216. The mixture 212 of liberated gas 214 and components 216 create a positive pressure inside reaction chamber 220. This positive pressure causes rupture vents 218 to open so as to allow mixture 212 to vent into headspace 278 of container 270. This venting allows gas 214 to expand within headspace 278 and develop a positive pressure within container 270, thereby expanding out recesses 282 caused by denting, buckling or paneling during the cooling step 254 and additionally providing structural rigidity to the container 270.

Furthermore, in the embodiment that includes pull tab 106, the temperature of the inductors 103 and 104 is further controlled to allow pressure bonded hermetic seal 242 to be converted into a non permanent welded seal, whereby the polyester coating on closure seal 101 melts down and bonds to neck finish 240 upon cooling.

The temperature of inductors 103 and 104 can be controlled by the intensity of the external energy provided by triggering device 286, the proximity of inductors 103 and 104 to triggering device 286, and the amount of time that inductors 103 and 104 are exposed to the electromagnetic field of triggering device 286. For example, the temperature can be controlled by controlling the amount of time that active closure 230 takes to pass through the electromagnetic field, that triggering device takes to pass by active closure 230 or that current is applied to inductor coil 288.

The reaction itself is controllable in the sense that the time of triggering is controlled to occur at any time after container 270 has cooled and returned to its design strength. This allows higher pressures to be created than would occur if liquid 272 were at the hot fill temperature. The higher pressure permits container 270 to expand and substantially eliminate any paneling or buckling that happened during cooling and additionally provide structural rigidity to the container 270.

In the next step generally designated by reference numeral 258, the reaction is completed. In this action, mixture 212 in headspace 278 separates allowing components 216 to dissolve or mix with liquid 272 while allowing gas 214 to remain in headspace 278. Active closure 201 remains on the now rigid container 270 until opened by the consumer.

The chemical reaction also release components 216. Components 216 are formulated as heat sensitive ingredients or functional components that are released into the container 270 by the reaction. Since the reaction is triggered only when the container 270 has cooled, components 216 are not degraded. The reason is that they are not subjected to extended periods of high temperature, but rather to a relatively brief period of high temperature during the reaction. These heat sensitive ingredients generally provide aromatic and flavor characteristics to liquid 272.

Figure 13:
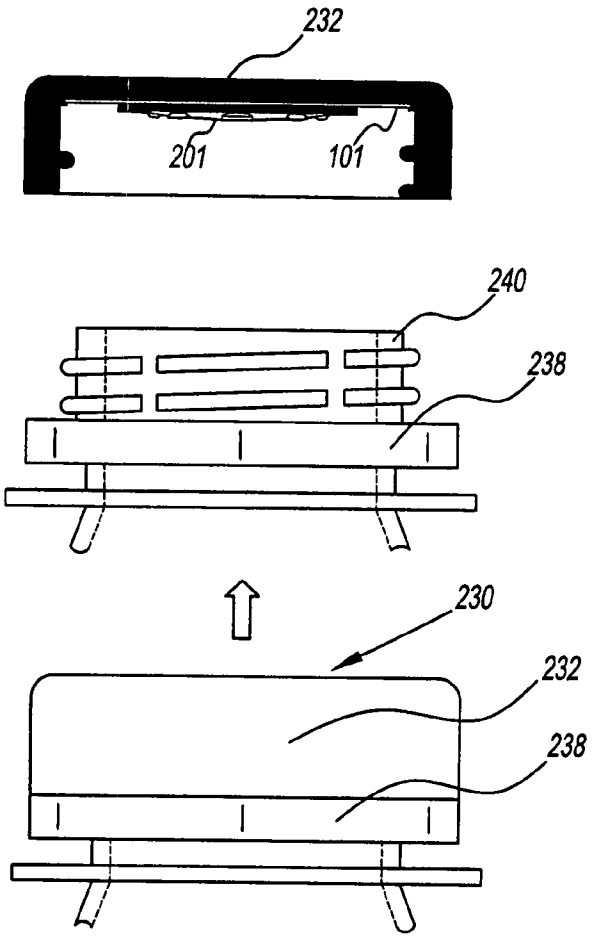
FIG. 13 is an exploded view as in FIG. 9, depicting the alternate embodiment of the active closure device after removal from a container neck.
Figure 12:
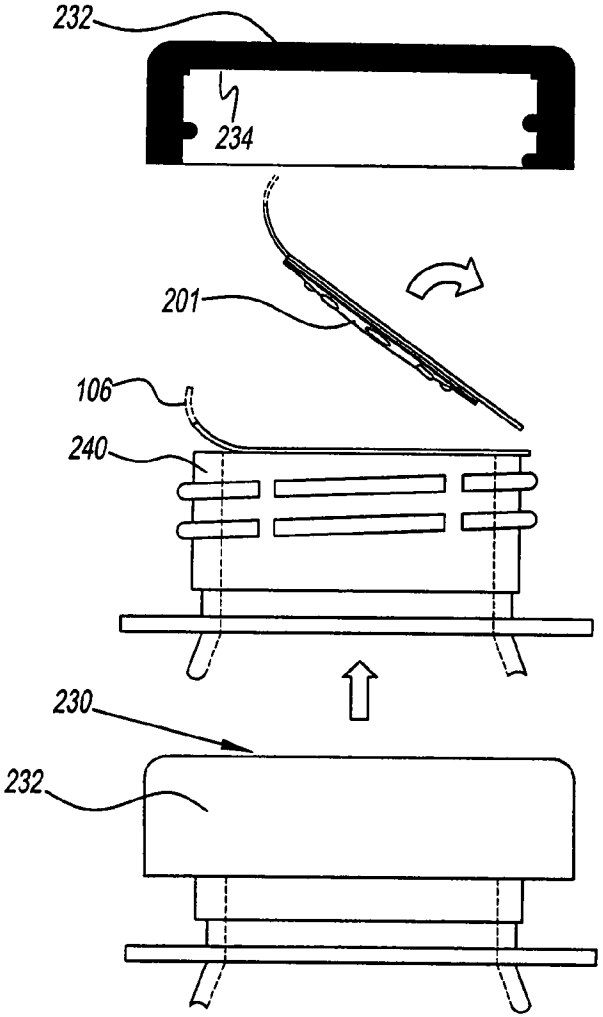
FIG. 12 is an exploded view as in FIG. 8, depicting the active closure device after removal from a container neck.

Referring to FIGS. 12 and 13, active closure 230 after activation is shown. In FIG. 12, active closure 230 comprises cap 232, secondary seal 234 and a spent insert device 201 with pull tab 106. When cap 232 is unscrewed and removed from neck finish 240, spent insert device 201 remains bonded to neck finish 240. Spent insert device 201 can then be removed by pulling pull tab 106 and tearing spent insert device 201 from neck finish 240. When container 270 is required to be re-sealed, cap 232 is screwed onto neck finish 240, thereby compressing secondary seal 234 and creating a new pressure bonded hermetic seal.

In FIG. 13, active closure 230 after activation (without pull tab) comprises cap 232, pilfer band 238 and spent insert device 201. When cap 232 is unscrewed and removed from neck finish 240, pilfer band 238 breaks and remains on neck finish 240 while spent insert device 201 remains in place inside cap 232. When container 270 is required to be re-sealed, cap 232 is screwed onto neck finish 240, thereby compressing closure seal 101 and re-creating the pressure bonded hermetic seal.

It will be apparent to those skilled in the art that changes can be made to the above described embodiments without departing from the scope of the invention. The list of examples of changes or modifications made below is not intended to be all encompassing or in any way limit the possible forms of the invention.

Figure 15:
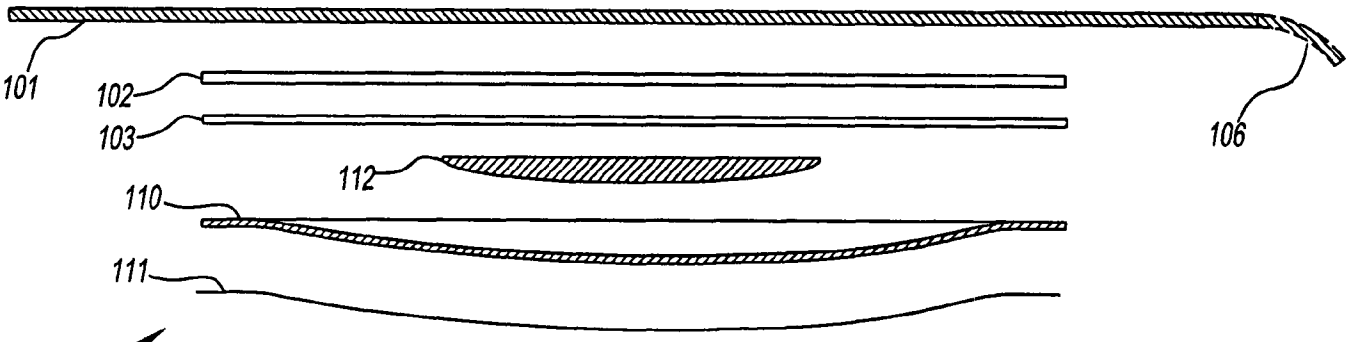
FIG. 15 depicts an exploded view of another alternate embodiment of the insert device of the present invention.

In one exemplary alternate embodiment depicted in FIG. 15, an insert device 120 includes a membrane 110 coated with a dissolvable coating 111. Upon exposure to liquid 272, coating 111 dissolves and allows liquid 272 from container 270 to penetrate through and moisten a compound 112. The moistening of compound 112 causes it to react and produce gas and by products. In this example, the same membrane 110 allows the gas to pass through it from the reaction while retaining or holding back any undesired components or by products. Additionally as an optional embodiment, an insulator 102 and a base inductor 103 can be added to assist with controlling or speeding up the reaction.

Figure 16:
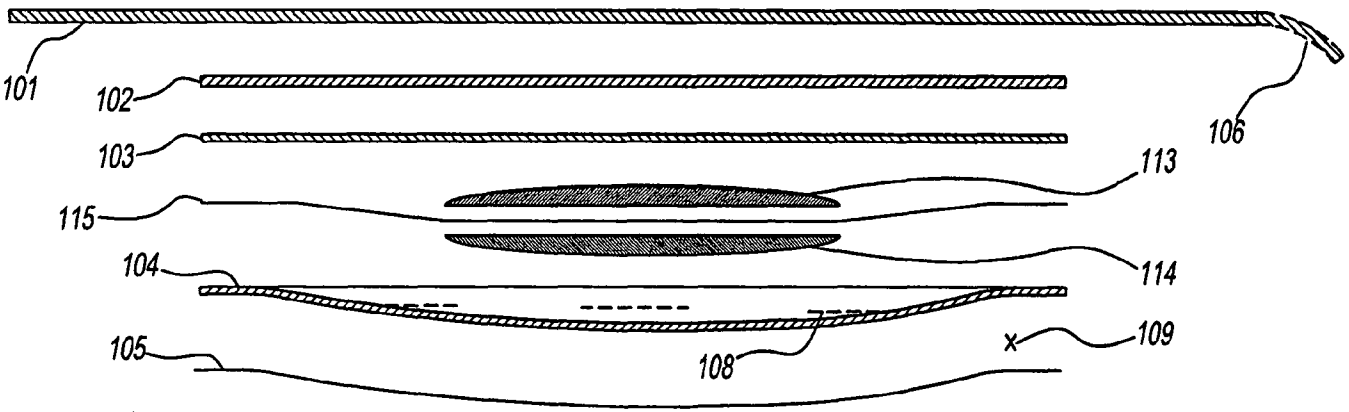
FIG. 16 depicts an exploded view of another alternate embodiment of the insert device of the present invention.

In another exemplary alternate embodiment depicted in FIG. 16, an insert device 130 contains a thin film separator 115 within a cavity or reaction chamber created by inductors 103 and 104. Thin film 115 separates reactive agent A 113 and reactive agent B 114 that react when exposed to one another. When inductors 103 and 104 are heated, thin film 115 melts away and allows reactive agents 113 and 114 to mix, thereby causing them to react.

Figure 17:
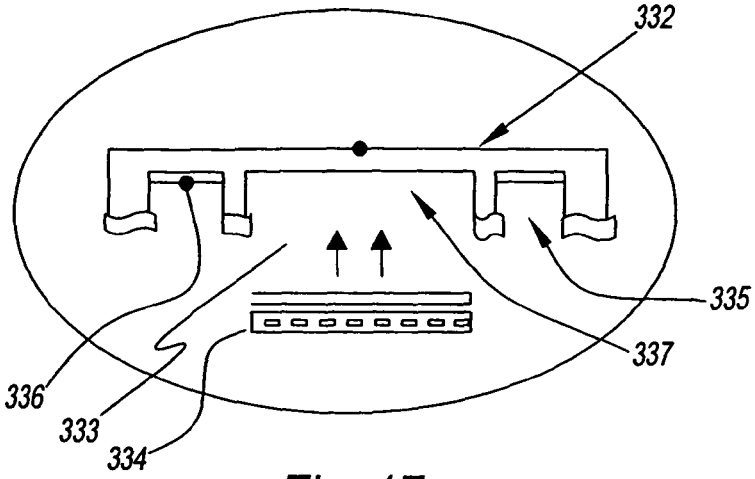
FIG. 17 is a cross-sectional view of an alternate embodiment of the closure device of the present invention.

Referring to FIG. 17, another exemplary alternate embodiment of the present invention includes a closure 332 that includes an annular slot 335 in which a neck seal 336 is disposed. Closure 332 includes a recess 337 in which an insert device 334 is inserted via mouth 333.

Insert device 334 functions to seal container 270, react and produce gas 214 and the by products or components 216, trigger, induce and control the reaction, retain or hold back certain by-products, provide protection, shielding, safety and security and provide structural strength and support. To accomplish these functions, insert 334 may include components, such as liners, seals, reactive agents, membranes, coatings, inductive plates, electrodes, dielectrics, absorbents, conductors, insulators, jackets, shields, fuses, spacers, stators, coils, films, catalysts and inhibitors and/or other components. Insert device 334 may be secured to the bottom of recess 337 in any suitable manner, known currently or in the future. For example, insert device 334 may be secured to the bottom of recess 337 by a force fit or chemical adhesive. Insert device 334, for example, may be any of the insert devices 201, 120 or 130 described above.

Figure 18:
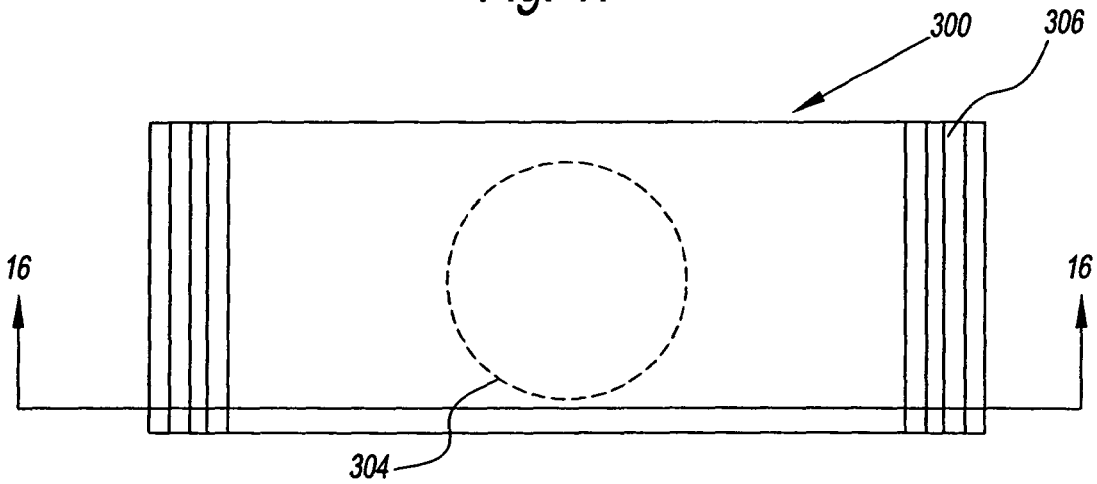
FIG. 18 is a top view of an alternate embodiment of the container of the present invention.
Figure 19:
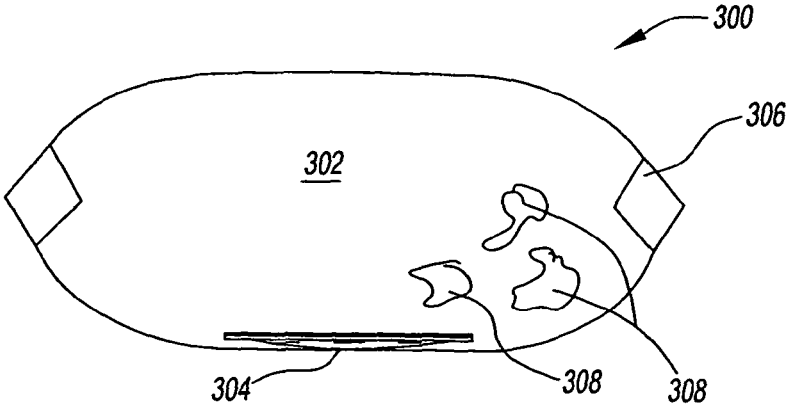
FIG. 19 is a cross-sectional view along line 19 of FIG. 18.

Referring to FIGS. 18 and 19, an alternate container 300 comprises a compartment 302 in which an insert 304 is disposed. Insert 304 may be either insert device 201 or 334. Insert 304 may be attached to an interior surface of container 300 or simply be unattached. One or more products 308 partially fill container 300. Products 308 may be food products, such as chips, candy, vegetables, and the like. Alternatively, products 308 may comprise one or more pieces of hardware, medical or dental supplies, parts, tools, and the like.

Container 300 is closed by a suitable fastener 306. For example, fastener 306 may be a typical form-fill-seal operation.

Container 300 is constructed of any suitable material that when closed and pressurized has a flexibility to be inflatable. For example, the material may have elastic properties or alternatively may be plastic, paper, metal, film or laminate that is closed in a loose fashion for inflation or pressurization.

In all cases the function of insert device 120, 130, 201 or 334 is not limited to that described in the preferred embodiments or the two preceding alternate embodiments. The insert device may function to seal the container, dispense contents, react and produce gas and components, trigger, induce and control a reaction, retain, filter or hold back certain by-products, provide protection, thermal containment, housing, shielding, safety and security and provide structural strength and support.

To accomplish these functions, the insert device may include components and layers, such as liners, seals, reactive agents, membranes, coatings, films, inductive plates, electrodes, dielectrics, absorbents, conductors, insulators, separators, jackets, shields, fuses, spacers, stators, coils, catalysts and inhibitors and/or other components all of which are held together by any suitable agent, such as adhesive or wax.

Membranes may be any suitable semi-permeable membrane that allows a fluid of specified size to penetrate and flow across the membrane. Membranes may be selected from the group that includes woven substrates, hollow fibers, composite materials or any other membrane materials available or yet to be developed.

Coatings are any suitable coatings that slowly dissolve or disintegrate when in contact with liquid. Coatings may be selected from the group consisting of sugars, starches, pill coatings or other dissolvable materials available or yet to be developed.

Pull tab 106 may be any pull tab design including a shape integrated into the closure seal 101 or an individual device attached thereto. An example of an individual device would be a half moon pull tab that sits on top of closure seal 101.

Triggering device 286 may alternatively produce external energy in the form of radiant heat, heated air, electromagnetic energy in the radio frequency (RF), high frequency (HF), very high frequency (VHF) and ultra high frequency (UHF) ranges, microwave, gamma, X-ray, ultraviolet, infrared, electromagnetic heat induction, ultrasonic energy, thermo sonic energy, laser energy, electric current and/or any combination thereof.

Score marks 108 may alternatively be any number including a random number and laid out in any pattern including a randomly distributed pattern.

Graphic panel 202 may be located on any surface of the insert device 201 and may include any graphics including promotional information, trade marking, product information in the form of text, figures or holograms.

It will be apparent to those skilled in the art that although insert device 201 is introduced into container 270 via active closure 230, other shapes of construction and other modes of introduction are contemplated. For example, insert device 201 could be introduced to container 270 prior to filling or closing.

Further it will be apparent to those skilled in the art that the application of this invention may be applied to all applications where it may be desirable to control the release of reactable or non reactable compounds in a closed filled container. Such applications include the use of this invention to: 1) dispense functional ingredients or components without a reaction directly into the head space and or liquid inside the container, 2) provide a blanket of specific gas in the head space of a container in order to blanket the liquid without significantly increasing or decreasing the pressure inside the container, 3) eliminate the effects of oxygen in the head space of the container by releasing or exposing an oxygen scavenger to the head space of the container or causing a reaction with the oxygen inside the head space of the container, 4) cause the liquid inside the container to become carbonated or absorb other gases from the headspace into solution, 5) cause the liquid inside the container to become agitated, and 6) cause the temperature of the liquid to be raised or lowered.

Additionally it will be apparent to those skilled in the art that the application of this invention may be applied to any and all containers and all filling methods in addition to hot and cold filling methods.

The present invention having been thus described with particular reference to the preferred forms thereof, it will be obvious that various changes and modifications may be made therein without departing from the spirit and scope of the present invention as defined in the appended claims.

What is claimed is:

1. An apparatus comprising:

a source of electromagnetic energy that comprises an induction coil that provides an electromagnetic field;

a sealed container that is located within said electromagnetic field and that has a flexibility to be inflatable;

an active insert device that is disposed inside said sealed container and within said electromagnetic field and that comprises a layered structure and a reactant, which is disposed between a first layer and a second layer of said layered structure, said first layer comprising an inductor in which an electrical current flows by induction from said electromagnetic field, and wherein as said electrical current flows, a temperature of said inductor rises to provide heat that triggers said reactant to a chemical reaction to produce a gas into said inflatable sealed container so as to inflate said sealed container.

2. The apparatus of claim 1, wherein said reactant is selected from the group consisting of: carbonates, nitrites, nitrates, ammonium compounds, acetates, ozones, peroxides and combinations thereof.

3. The apparatus of claim 1, wherein said insert further comprises a member of the group consisting of: components, liners, seals, reactive agents, membranes, coatings, films, inductive plates, electrodes, dielectrics, absorbents, conductors, insulators, separators, jackets, shields, fuses, spacers, stators, coils, catalysts, inhibitors and any combination thereof.

4. The apparatus of claim 1, wherein said reaction occurs in a chamber between said first layer and said second layer.

5. The apparatus of claim 4, wherein a third layer of said layered structure separates said reactant from an agent and is at least partially modified by said heat to allow said reactant and said agent to come into contact in said chamber to initiate said reaction in said chamber.

6. The apparatus of claim 1, wherein said first layer includes one or more weakened areas that rupture as said gas pressurizes said chamber to allow said gas to escape into said container.

7. The apparatus of claim 1, wherein said sealed container is constructed of a material that has an elastic property or a material that is closed in a loose fashion for inflation.

8. The apparatus of claim 7, wherein said material that is closed in a loose fashion for inflation is selected from the group consisting of: plastic, paper, metal, film and laminate.

9. The apparatus of claim 1, wherein said second layer is also an inductor.

10. The apparatus of claim 1, wherein said first layer and said second layer are joined together by a bonding agent.

11. The apparatus of claim 1, wherein said bonding agent is selected from the group consisting of: adhesives, waxes, gums and epoxies.

* * * * *